US011501688B2

(12) United States Patent
Kim et al.

(10) Patent No.: US 11,501,688 B2
(45) Date of Patent: Nov. 15, 2022

(54) DISPLAY DEVICE SELECTIVELY PERFORMING A MURA CORRECTION OPERATION, AND METHOD OF OPERATING A DISPLAY DEVICE

(71) Applicant: Samsung Display Co., Ltd., Yongin-si (KR)

(72) Inventors: Jong-Keun Kim, Hwaseong-si (KR); Sang An Kwon, Cheonan-si (KR); Sung Jin Kim, Gwangju (KR); Yong-Bum Kim, Suwon-si (KR); Myung Bo Sim, Yesan-gun (KR); Jin Sung Choi, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/165,762

(22) Filed: Feb. 2, 2021

(65) Prior Publication Data

US 2021/0327334 A1 Oct. 21, 2021

(30) Foreign Application Priority Data

Apr. 21, 2020 (KR) ..... 10-2020-0048242

(51) Int. Cl.
*G09G 3/20* (2006.01)
*G09G 3/36* (2006.01)
(Continued)

(52) U.S. Cl.
CPC ..... *G09G 3/2074* (2013.01); *G09G 3/3266* (2013.01); *G09G 3/3275* (2013.01);
(Continued)

(58) Field of Classification Search
CPC .. G09G 3/2074; G09G 3/3266; G09G 3/3275; G09G 3/3677; G09G 3/3688;
(Continued)

(56) References Cited

U.S. PATENT DOCUMENTS 5,842,059 A * 11/1998 Suda ..... G02B 7/102 396/101
2007/0132895 A1* 6/2007 Shen ..... G09G 3/2007 349/1
(Continued)

FOREIGN PATENT DOCUMENTS

KR 10-2016-0080237 A 7/2016
KR 10-1676608 B1 11/2016

*Primary Examiner* — Stephen G Sherman
(74) *Attorney, Agent, or Firm* — Lewis Roca Rothgerber Christie LLP

(57) ABSTRACT

A display device includes a display panel including a plurality of pixels, a gate driver configured to provide gate signals to the plurality of pixels, a data driver configured to provide data signals to the plurality of pixels, a correction data memory configured to store mura correction data, and a controller configured to control the gate driver and the data driver. The controller includes a pattern detection block configured to detect a set pattern in input image data, and a mura correction block configured to perform a mura correction operation that corrects the input image data based on the mura correction data in response to the set pattern not being detected, and to not perform the mura correction operation in accordance with the set pattern being detected.

20 Claims, 14 Drawing Sheets

(51) Int. Cl.
*G09G 3/3275* (2016.01)
*G09G 3/3266* (2016.01)

(52) U.S. Cl.
CPC ..... *G09G 3/3677* (2013.01); *G09G 3/3688* (2013.01); *G09G 2320/0233* (2013.01); *G09G 2320/041* (2013.01); *G09G 2330/021* (2013.01); *G09G 2360/12* (2013.01)

(58) Field of Classification Search
CPC ..... G09G 2320/0233; G09G 2320/041; G09G 2330/021; G09G 2360/12
See application file for complete search history.

(56) References Cited

U.S. PATENT DOCUMENTS

2008/0291326 A1* 11/2008 Shishido ..... G09G 3/3611 348/555
2009/0289965 A1* 11/2009 Kurokawa ..... G09G 3/3406 345/690
2014/0035966 A1* 2/2014 Inagaki ..... G09G 5/10 345/690
2014/0168188 A1* 6/2014 Jun ..... G09G 3/3233 345/212
2015/0206276 A1* 7/2015 Jung ..... G09G 5/00 345/561
2018/0108288 A1* 4/2018 Kuang ..... G09G 3/36

* cited by examiner

FIG. 6

| 2H DOT PATTERN SIZE | | TEMPERATURE (MURA CORRECTION) | MURA CORRECTION | TEMPERATURE (SELECTIVE MURA CORRECTION) |
|---|---|---|---|---|
| HORIZONTAL | VERTICAL | | | |
| 2560 | 1080 | 109.5°C | OFF | 96.6°C |
| 2460 | 1020 | 107.3°C | | |
| 2360 | 960 | 105.3°C | | |
| 2260 | 900 | 103.8°C | | |
| 2160 | 840 | 103.8°C | | |
| 2060 | 780 | 100.8°C | ON | 100.8°C |
| 1960 | 720 | 100.3°C | | 100.3°C |
| 1860 | 660 | 99.8°C | | 99.8°C |
| 1760 | 600 | 97.6°C | | 97.6°C |
| 1660 | 540 | 96.2°C | | 96.2°C |

FIG. 7

| | TEMPERATURE (TCON) | | TEMPERATURE (PMIC) | |
|---|---|---|---|---|
| MURA CORRECTION | ON | OFF | ON | OFF |
| WHITE PATTERN | 87.2°C | X | 81.8°C | X |
| COLOR BAR PATTERN | 89.4°C | X | 85.7°C | X |
| 2H DOT PATTERN | 109.5°C | 96.6°C | 91.1°C | 76.1°C |
| H-STRIPE PATTERN | 90.4°C | X | 88.2°C | X |
| CHECKER PATTERN | 96.2°C | X | 91.9°C | X |
| TEMPERATURE CRITERION | 103.5°C | | 106.7°C | |

DISPLAY DEVICE SELECTIVELY PERFORMING A MURA CORRECTION OPERATION, AND METHOD OF OPERATING A DISPLAY DEVICE

CROSS-REFERENCE TO RELATED APPLICATION

This application claims priority to and the benefit of Korean Patent Application No. 10-2020-0048242, filed on Apr. 21, 2020 in the Korean Intellectual Property Office (KIPO), the entire content of which is incorporated herein by reference.

BACKGROUND

1. Field

Exemplary embodiments of the present inventive concept relate to a display device, and more particularly to a display device selectively performing a mura correction operation, and a method of operating the display device.

2. Description of the Related Art

Even if a plurality of pixels included in a display device is manufactured by the same process, the plurality of pixels may have different luminances and different color coordinates from each other due to a process variation or the like. Thus, a luminance mura defect and/or a color mura defect may occur in the display device. To reduce or eliminate the luminance and/or color mura defects, and to improve luminance and/or color coordinate uniformity of the display device, an image displayed by the display device in a module state may be captured, mura correction data may be generated based on the captured image, and the mura correction data may be stored in the display device. The display device may correct image data based on the stored mura correction data, and may display an image based on the corrected image data, thereby displaying the image with uniform luminance and/or uniform color coordinate (e.g., without the luminance and/or color mura defects).

However, by this mura correction operation, a temperature of components (e.g., a controller and/or a power management circuit) of the display device may be increased. Further, by this temperature increase, the display device may be damaged or not operate normally (e.g., operate as desired).

SUMMARY

Aspects of one or more exemplary (i.e., example) embodiments are directed towards a display device capable of preventing or substantially preventing an excessive temperature increase.

Aspects of one or more exemplary embodiments are directed towards a method of operating a display device capable of preventing or substantially preventing an excessive temperature increase.

According to exemplary embodiments, there is provided a display device including a display panel including a plurality of pixels, a gate driver configured to provide gate signals to the plurality of pixels, a data driver configured to provide data signals to the plurality of pixels, a correction data memory configured to store mura correction data, and a controller configured to control the gate driver and the data driver. The controller includes a pattern detection block configured to detect a set (e.g., predetermined) pattern in input image data, and a mura correction block configured to perform a mura correction operation that corrects the input image data based on the mura correction data in response to the set (e.g., predetermined) pattern not being detected, and to not perform the mura correction operation in response to the set (e.g., predetermined) pattern being detected.

In exemplary embodiments, the set (e.g., predetermined) pattern may be a two-horizontal dot pattern.

In exemplary embodiments, the plurality of pixels may include a first sub-pixel, a second sub-pixel, a third sub-pixel, a fourth sub-pixel, a fifth sub-pixel, a sixth sub-pixel, a seventh sub-pixel, an eighth sub-pixel, a ninth sub-pixel, a tenth sub-pixel, an eleventh sub-pixel, and a twelfth sub-pixel that are sequentially arranged in a horizontal direction, and the set (e.g., predetermined) pattern may include high gray data for the first sub-pixel, the second sub-pixel, the third sub-pixel, the fourth sub-pixel, the fifth sub-pixel, and the sixth sub-pixel and low gray data for the seventh sub-pixel, the eighth sub-pixel, the ninth sub-pixel, the tenth sub-pixel, the eleventh sub-pixel, and the twelfth sub-pixel. For example, the plurality of pixels may include a first pixel, a second pixel, a third pixel, and a fourth pixel, the first pixel may include the first sub-pixel, the second sub-pixel, and the third sub-pixel, the second pixel may include the fourth sub-pixel, the fifth sub-pixel, and the sixth sub-pixel, and so on.

In exemplary embodiments, the high gray data may be image data representing a gray level higher than or equal to a reference gray level, and the low gray data may be image data representing a gray level lower than the reference gray level.

In exemplary embodiments, the pattern detection block may generate a mura correction control signal having a first level in response to the input image data corresponding to the set (e.g., predetermined) pattern with respect to a number of pixels from among the plurality of pixels that is less than a reference pixel number, and may generate the mura correction control signal having a second level in response to the input image data corresponding to the set (e.g., predetermined) pattern with respect to the number of pixels from among the plurality of pixels that is greater than or equal to the reference pixel number. The mura correction block may perform the mura correction operation in response to the mura correction control signal having the first level, and may not perform the mura correction operation in accordance with the mura correction control signal having the second level.

In exemplary embodiments, the pattern detection block may count a number of one or more set (e.g., predetermined) patterns including the set (e.g., predetermined) pattern in the input image data for one frame, may generate a mura correction control signal having a first level in response to the counted number of the one or more set (e.g., predetermined) patterns being less than a reference pattern number, and may generate the mura correction control signal having a second level in response to the counted number of the one or more set (e.g., predetermined) patterns being greater than or equal to the reference pattern number. The mura correction block may perform the mura correction operation in response to the mura correction control signal having the first level, and may not perform the mura correction operation in accordance with the mura correction control signal having the second level.

In exemplary embodiments, the mura correction data may represent a plurality of correction values at a plurality of sampling gray levels. With respect to each pixel, the mura correction block may perform the mura correction operation for the each pixel by linearly interpolating the plurality of correction values at two sampling gray levels from among the plurality of sampling gray levels. The two sampling gray levels may be adjacent to a gray level of the input image data for the each pixel.

In exemplary embodiments, the mura correction data may represent a plurality of correction values at a plurality of sampling positions. With respect to each pixel, the mura correction block may perform the mura correction operation for the each pixel by performing a bilinear interpolation on the plurality of correction values at four sampling positions from among the plurality of sampling positions adjacent to the each pixel.

In exemplary embodiments, a temperature of the controller may decrease in accordance with the mura correction operation not being performed.

In exemplary embodiments, the display device may further include a power management circuit configured to provide a power supply voltage to the controller. A temperature of the power management circuit may decrease in accordance with the mura correction operation not being performed.

In exemplary embodiments, the display device may further include a frame memory configured to store the input image data for one frame, and a pattern memory configured to store pattern data having the set (e.g., predetermined) pattern. The pattern detection block may detect the set (e.g., predetermined) pattern in the input image data by comparing the input image data stored in the frame memory and the pattern data stored in the pattern memory.

In exemplary embodiments, the controller may further include a temperature sensor configured to sense a temperature of the controller.

In exemplary embodiments, the pattern detection block may count a number of one or more set (e.g., predetermined) patterns including the set (e.g., predetermined) pattern in the input image data for one frame, may compare the temperature of the controller sensed by the temperature sensor with a reference temperature, may generate a mura correction control signal having a first level in response to the counted number of the one or more set (e.g., predetermined) patterns being less than a reference pattern number or in response to the temperature of the controller being less than the reference temperature, and may generate the mura correction control signal having a second level in response to the counted number of the one or more set (e.g., predetermined) patterns being greater than or equal to the reference pattern number and the temperature of the controller being greater than or equal to the reference temperature. The mura correction block may perform the mura correction operation in response to the mura correction control signal having the first level, and may not perform the mura correction operation in accordance with the mura correction control signal having the second level.

In exemplary embodiments, the controller may further include a driving frequency detector configured to detect a frame frequency of the input image data.

In exemplary embodiments, the pattern detection block may count a number of one or more set (e.g., predetermined) patterns including the set (e.g., predetermined) pattern in the input image data for one frame, may compare the frame frequency detected by the driving frequency detector with a reference frequency, may generate a mura correction control signal having a first level in response to the counted number of the one or more set (e.g., predetermined) patterns being less than a reference pattern number or in response to the frame frequency being less than the reference frequency, and may generate the mura correction control signal having a second level in response to the counted number of the one or more set (e.g., predetermined) patterns being greater than or equal to the reference pattern number and the frame frequency being greater than or equal to the reference frequency. The mura correction block may perform the mura correction operation in response to the mura correction control signal having the first level, and may not perform the mura correction operation in accordance with the mura correction control signal having the second level.

According to exemplary embodiments, there is provided a method of operating a display device. In the method, mura correction data are stored, input image data are received, a set (e.g., predetermined) pattern is detected in the input image data, a display panel is driven based on corrected image data by performing a mura correction operation that corrects the input image data based on the mura correction data in response to the set (e.g., predetermined) pattern not being detected, and the display panel is driven based on the input image data without performing the mura correction operation in accordance with the set (e.g., predetermined) pattern being detected.

In exemplary embodiments, a number of the set (e.g., predetermined) patterns in the input image data for one frame may be counted, a mura correction control signal having a first level may be generated in response to the counted number of the one or more set (e.g., predetermined) patterns being less than a reference pattern number, and the mura correction control signal having a second level may be generated in response to the counted number of the one or more set (e.g., predetermined) patterns being greater than or equal to the reference pattern number. The mura correction operation may be performed in response to the mura correction control signal has having first level, and may not be performed in accordance with the mura correction control signal having the second level.

In exemplary embodiments, the input image data for one frame may be stored in a frame memory, and pattern data having the set (e.g., predetermined) pattern may be stored in a pattern memory. The set (e.g., predetermined) pattern may be detected in the input image data by comparing the input image data stored in the frame memory and the pattern data stored in the pattern memory.

In exemplary embodiments, a temperature of a controller may be sensed by using a temperature sensor, a number of the one or more set (e.g., predetermined) patterns including the set (e.g., predetermined) pattern in the input image data for one frame may be counted, the temperature of the controller sensed by the temperature sensor may be compared with a reference temperature, a mura correction control signal having a first level may be generated in response to the counted number of the one or more set (e.g., predetermined) patterns being less than a reference pattern number or in response to the temperature of the controller being less than the reference temperature, and the mura correction control signal having a second level may be generated in response to the counted number of the one or more set (e.g., predetermined) patterns being greater than or equal to the reference pattern number and the temperature of the controller being greater than or equal to the reference temperature. The mura correction operation may be performed in response to the mura correction control signal having the first level, and may not be performed in accordance with the mura correction control signal having the second level.

In exemplary embodiments, a frame frequency of the input image data may be detected by using a driving frequency detector, a number of the one or more set (e.g., predetermined) patterns including the set (e.g., predetermined) pattern in the input image data for one frame may be counted, the frame frequency detected by the driving frequency detector may be compared with a reference frequency, a mura correction control signal having a first level may be generated in response to the counted number of the one or more set (e.g., predetermined) patterns being less than a reference pattern number or in response to the frame frequency being less than the reference frequency, and the mura correction control signal having a second level may be generated in response to the counted number of the one or more set (e.g., predetermined) patterns being greater than or equal to the reference pattern number and the frame frequency being greater than or equal to the reference frequency. The mura correction operation may be performed in response to the mura correction control signal having the first level, and may not be performed in accordance with the mura correction control signal having the second level.

As described above, in a display device and a method of operating the display device according to exemplary embodiments, a set (e.g., predetermined) pattern may be detected in input image data, a mura correction operation that corrects the input image data based on mura correction data when the set (e.g., predetermined) pattern is not detected, and the mura correction operation may not be performed when the set (e.g., predetermined) pattern is detected. Accordingly, an excessive temperature increase of components (e.g., a controller and/or a power management circuit) of the display device caused by the mura correction operation may be prevented or substantially prevented.

BRIEF DESCRIPTION OF THE DRAWINGS

Illustrative, non-limiting exemplary embodiments will be more clearly understood from the following detailed description in conjunction with the accompanying drawings.

FIG. 6 is a diagram for describing an example of a temperature of a controller according to a size of a set pattern.

FIG. 7 is a diagram for describing examples of a temperature of a controller and a temperature of a power management circuit according to a plurality of patterns.

DETAILED DESCRIPTION

Figure 1:
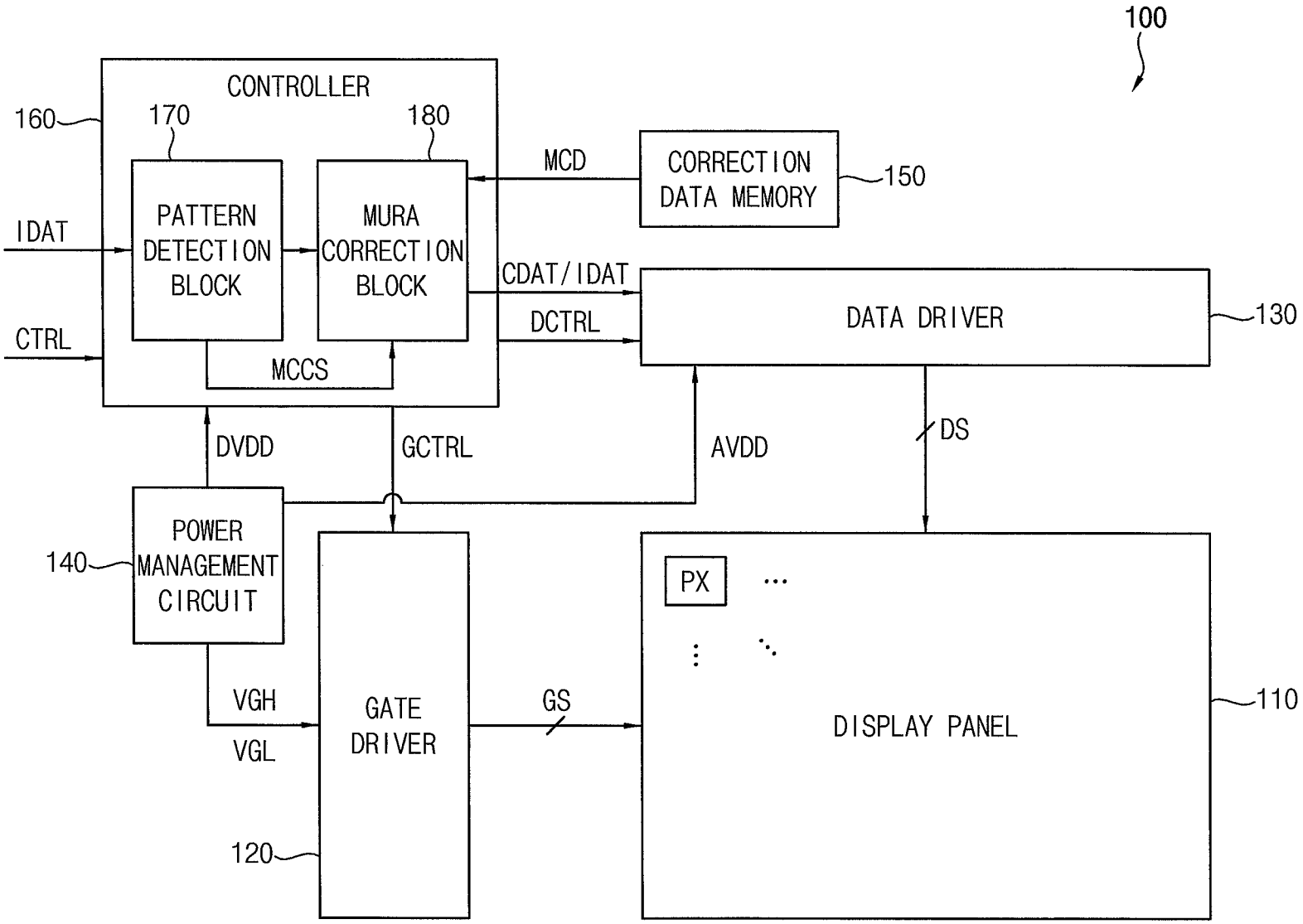
FIG. 1 is a block diagram illustrating a display device according to exemplary embodiments.

Hereinafter, embodiments of the present inventive concept will be explained in detail with reference to the accompanying drawings. Like reference numerals in the drawings denote like elements throughout, and duplicative descriptions thereof may not be provided.

The terminology used herein is for the purpose of describing particular example embodiments only and is not intended to limit the example embodiments described herein.

As used herein, the singular forms "a," "an," and "the" are intended to include the plural forms as well, unless the context clearly indicates otherwise.

It will be further understood that the terms "includes," "including," "comprises," and/or "comprising," when used in this specification, specify the presence of stated features, steps, operations, elements, and/or components, but do not preclude the presence or addition of one or more other features, steps, operations, elements, components, and/or groups thereof.

As used herein, the term "and/or" includes any and all combinations of one or more of the associated listed items.

Further, the use of "may" when describing embodiments of the present disclosure refers to "one or more embodiments of the present disclosure".

It will be understood that when an element is referred to as being "on," "connected to," or "coupled to" another element, it may be directly on, connected, or coupled to the other element or one or more intervening elements may also be present. When an element is referred to as being "directly on," "directly connected to," or "directly coupled to" another element, there are no intervening elements present.

As used herein, the terms "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
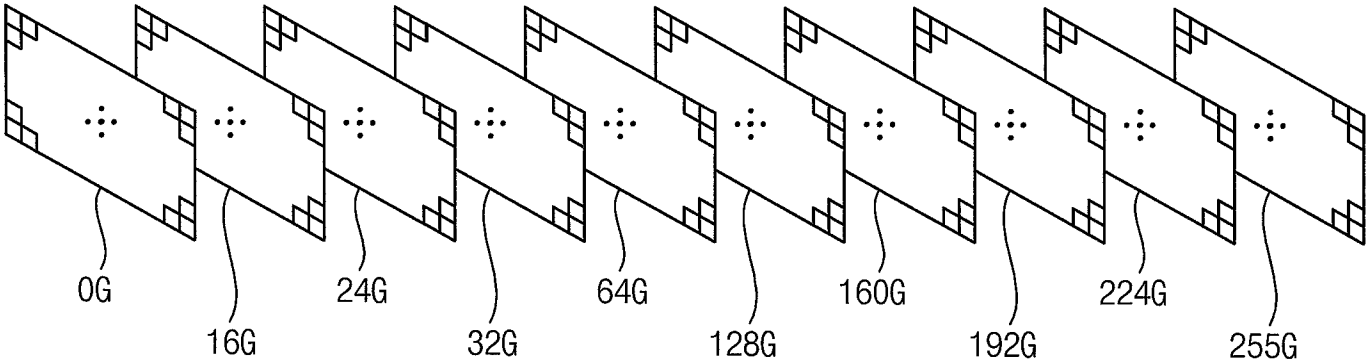
FIG. 2 is a diagram for describing an example of a plurality of sampling gray levels at which a plurality of correction values of mura correction data is obtained.
Figure 3:
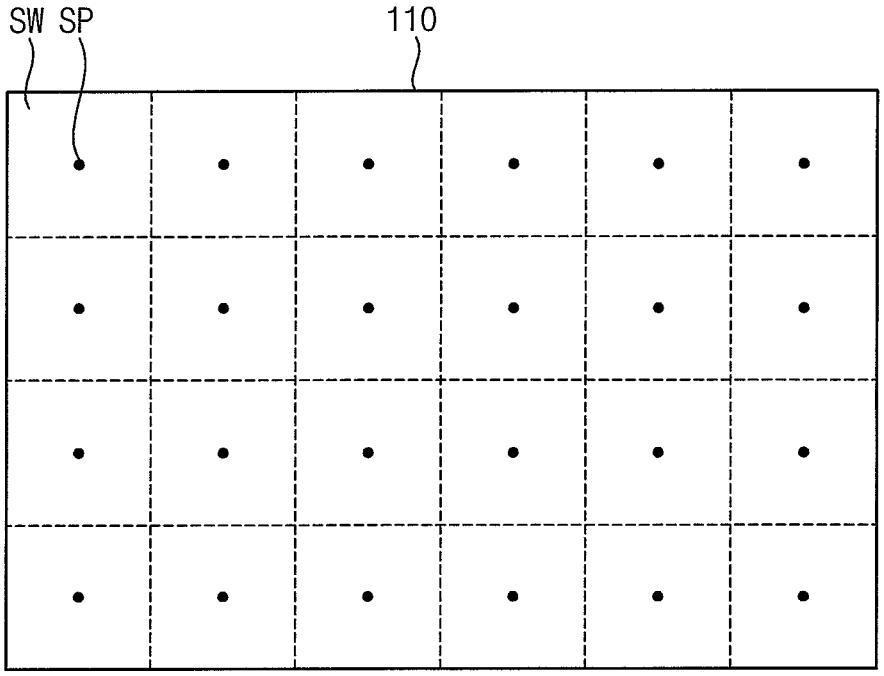
FIG. 3 is a diagram for describing an example of a plurality of sampling positions at which a plurality of correction values of mura correction data is obtained.
Figure 4:
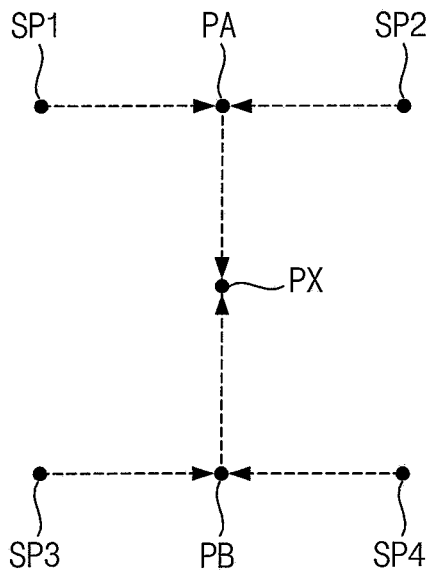
FIG. 4 is a diagram for describing an example of a bilinear interpolation performed by a mura correction block.
Figure 5:
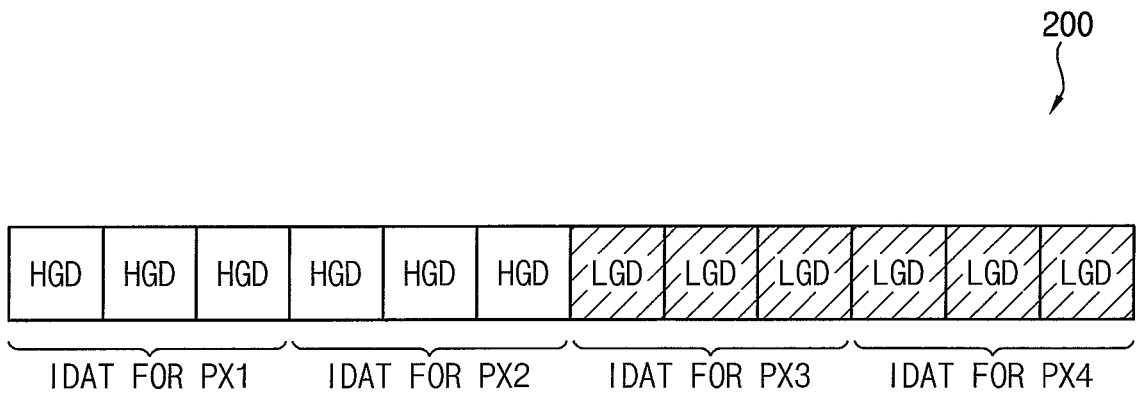
FIG. 5 is a diagram for describing an example of a set pattern detected by a pattern detection block.

FIG. 1 is a block diagram illustrating a display device according to exemplary embodiments, FIG. 2 is a diagram for describing an example of a plurality of sampling gray levels at which a plurality of correction values of mura correction data is obtained, FIG. 3 is a diagram for describing an example of a plurality of sampling positions at which a plurality of correction values of mura correction data is obtained, FIG. 4 is a diagram for describing an example of a bilinear interpolation performed by a mura correction block, FIG. 5 is a diagram for describing an example of a set (e.g., predetermined) pattern detected by a pattern detection block, FIG. 6 is a diagram for describing an example of a temperature of a controller according to a size of a set (e.g., predetermined) pattern, and FIG. 7 is a diagram for describing examples of a temperature of a controller and a temperature of a power management circuit according to a plurality of patterns.

Referring to FIG. 1, a display device 100 according to exemplary embodiments may include a display panel 110 that includes a plurality of pixels PX, a gate driver 120 that provides gate signals GS to the plurality of pixels PX, a data driver 130 that provides data signals DS to the plurality of pixels PX, a power management circuit 140 that supplies power to the display device 100, a correction data memory 150 that stores mura correction data CD, and a controller 160 that controls an operation of the display device 100.

The display panel 110 may include a plurality of data lines, a plurality of gate lines, and the plurality of pixels PX coupled to the plurality of data lines and the plurality of gate lines. In some exemplary embodiments, each pixel PX may include a switching transistor and a liquid crystal capacitor coupled to the switching transistor, and the display panel 110 may be a liquid crystal display (LCD) panel. In other exemplary embodiments, each pixel PX may include at least two transistors, at least one capacitor and an organic light emitting diode (OLED), and the display panel 110 may be an OLED display panel. However, the display panel 110 is not limited to the LCD panel and the OLED display panel. In other words, the display panel 110 may be any suitable display panel.

The gate driver 120 may generate the gate signals GS based on a gate control signal GCTRL received from the controller 160, and may provide the gate signals GS to the plurality of pixels PX through the plurality of gate lines. In some exemplary embodiments, the gate control signal GCTRL may include, but not be limited to, a gate start signal and a gate clock signal. In some exemplary embodiments, the gate driver 120 may be implemented as an amorphous silicon gate (ASG) driver integrated in a peripheral portion of the display panel 110. In other exemplary embodiments, the gate driver 120 may be implemented with one or more gate integrated circuits. Further, according to some exemplary embodiments, the gate driver 120 may be mounted on (e.g., directly on) the display panel 110 in a chip on glass (COG) manner or a chip on plastic (COP) manner, or may be coupled to the display panel 110 in a chip on film (COF) manner.

The data driver 130 may generate the data signals DS based on corrected image data CDAT or input image data IDAT, and a data control signal DCTRL received from the controller 160, and may provide the data signals DS to the plurality of pixels PX through the plurality of data lines. For example, the data control signal DCTRL may include, but not be limited to, an output data enable signal, a data clock signal and a load signal. In some exemplary embodiments, the data driver 130 may be implemented with one or more data integrated circuits. Further, according to some exemplary embodiments, the data driver 130 may be mounted on (e.g., directly on) the display panel 110 in the COG manner or the COP manner, or may be coupled to the display panel 110 in the COF manner. In other exemplary embodiments, the data driver 130 may be integrated in the peripheral portion of the display panel 110. For example, the data driver 130 may be integrated into a non-display area (portion) of the display panel 110 surrounding the display area (portion) of the display panel 110.

The power management circuit 140 may receive an input voltage (e.g., a battery voltage or a system voltage) from an external power source, and may convert the input voltage into voltages desired for an operation of the display device 100. In some exemplary embodiments, as illustrated in FIG. 1, the power management circuit 140 may generates high and low gate voltages VGH and VGL for the gate driver 120, a power supply voltage (e.g., an analog power supply voltage AVDD) for the data driver 130, and a power supply voltage (e.g., a digital power supply voltage DVDD) for the controller 160. In some exemplary embodiments, the power management circuit 140 may be implemented with an integrated circuit, and the integrated circuit may be referred to as a power management integrated circuit (PMIC). In other example embodiments, the power management circuit 140 may be included in the controller 160, but the location of the power management circuit 140 is not limited thereto.

The correction data memory 150 may store the mura correction data MCD for mura correction of the display panel 110. For example, when the display device 100 is manufactured, tristimulus data may be obtained by capturing an image displayed at the display panel 110, the mura correction data MCD may be generated based on the tristimulus data, and the mura correction data MCD may be stored in the correction data memory 150.

In some exemplary embodiments, the mura correction data MCD may include a plurality of correction values at the entire gray levels (e.g., 256 gray levels from 0-gray level to 255-gray level). In other exemplary embodiments, to reduce a size of the mura correction data MCD, the mura correction data MCD may include a plurality of correction values at one or more sampling gray levels that are a portion of the entire gray levels. For example, as illustrated in FIG. 2, the mura correction data MCD may include the plurality of correction values at ten sampling gray levels, (e.g., 0-gray level 0G, 16-gray level 16G, 24-gray level 24G, 32-gray level 32G, 64-gray level 64G, 128-gray level 128G, 160-gray level 160G, 192-gray level 192G, 224-gray level 224G and 255-gray level 255G). However, the sampling gray levels according to exemplary embodiments are not limited to the ten sampling gray levels illustrated in FIG. 2.

Further, in some exemplary embodiments, the mura correction data MCD may include a plurality of correction values for the entire pixels PX. In other words, the mura correction data MCD may include a plurality of correction values corresponding to each of the plurality of pixels PX. In other exemplary embodiments, to reduce the size of the mura correction data MCD, the mura correction data MCD may include a plurality of correction values for a portion of the plurality of pixels PX. For example, as illustrated in FIG. 3, the display panel 110 may be divided into a plurality of sampling windows SW each including two or more pixels PX, and the mura correction data MCD may include a correction value at one sampling position SP per each sampling window SW. In other words, the mura correction data MCD may include a plurality of correction values corresponding to each of the plurality of sampling windows SW. In an example embodiment, as illustrated in FIG. 3, each sampling position SP may correspond to, but not be limited to, a center point of a corresponding sampling window SW.

The controller 160 (e.g., a timing controller (TCON)) may receive the input image data IDAT and a control signal CTRL from an external host processor (e.g., a graphic processing unit (GPU) or a graphic card). In some exemplary embodiments, the control signal CTRL may include, but not be limited to, a vertical synchronization signal, a horizontal synchronization signal, an input data enable signal, a master clock signal, etc. The controller 160 according to exemplary embodiments may selectively generate the corrected image data CDAT by selectively performing the mura correction (or a mura correction operation) using the mura correction data MCD. Further, the controller 160 may generate the gate control signal GCTRL and the data control signal DCTRL based on the control signal CTRL. Further, the controller 160 may control an operation of the gate driver 120 by providing the gate control signal GCTRL to the gate driver 120, and may control an operation of the data driver 130 by providing the corrected image data CDAT or the input image data IDAT, and the data control signal DCTRL to the data driver 130.

In the display device 100 according to exemplary embodiments, the controller 160 may include a mura correction block 180 that performs a mura correction operation that generates the corrected image data CDAT by correcting the input image data IDAT based on the mura correction data MCD stored in the correction data memory 150.

In some exemplary embodiments, the mura correction data MCD may include a plurality of correction values at a plurality of sampling gray levels 0G, 16G, 24G, 32G, 64G, 128G, 160G, 192G, 224G and 255G illustrated in FIG. 2, and, with respect to each pixel PX, the mura correction block 180 may perform the mura correction operation for the pixel PX by linearly interpolating the correction values at two sampling gray levels adjacent to a gray level of the input image data IDAT for the pixel PX from among the plurality of sampling gray levels 0G, 16G, 24G, 32G, 64G, 128G, 160G, 192G, 224G and 255G.

Further, in some exemplary embodiments, the mura correction data MCD may include a plurality of correction values at a plurality of sampling positions SP illustrated in FIG. 3, and, with respect to each pixel PX, the mura correction block 180 may perform the mura correction operation for the pixel PX by performing a bilinear interpolation on the correction values at four sampling positions (e.g., a first sampling position SP1, a second sampling position SP2, a third sampling position SP3, and a fourth sampling position SP4) adjacent (e.g., directly adjacent) to the pixel PX from among the plurality of sampling positions SP. In some exemplary embodiments, the plurality of sampling positions may be sampling points as illustrated in FIGS. 3 and 4. As illustrated in FIG. 4, to perform the mura correction operation for the pixel PX, the mura correction block 180 may perform the bilinear interpolation on correction values at first through fourth sampling positions SP1, SP2, SP3 and SP4 adjacent (e.g., directly adjacent) to the pixel PX. That is, the mura correction block 180 may calculate a correction value at a first intermediate position PA by performing a linear interpolation on the correction values at the first and second sampling positions SP1 and SP2, may calculate a correction value at a second intermediate position PB by performing a linear interpolation on the correction values at the third and fourth sampling positions SP3 and SP4, and may calculate a correction value for the pixel PX by performing a linear interpolation on the correction values at the first and second intermediate positions PA and PB. In some exemplary embodiments, both of the linear interpolation between gray levels and the bilinear interpolation may be performed. According to exemplary embodiments, the linear interpolation between gray levels may be performed after the bilinear interpolation is performed, or may be performed before the bilinear interpolation is performed.

However, by the mura correction operation, a temperature of components (e.g., the controller 160 and/or the power management circuit 140) of the display device 100 may be increased. Further, by the temperature increase, the display device 100 may be damaged or not operate normally (e.g., operate as desired). To prevent or substantially prevent the excessive temperature increase by the mura correction operation, in the display device 100 according to exemplary embodiments, the controller 160 may further include a pattern detection block 170 that detects a set (e.g., predetermined) pattern in the input image data IDAT, and the mura correction block 180 may selectively perform the mura correction operation according to whether the set (e.g., predetermined) pattern is detected or not. Thus, the mura correction block 180 may perform the mura correction operation that corrects the input image data IDAT based on the mura correction data MCD when the set (e.g., predetermined) pattern is not detected by the pattern detection block 170, and the mura correction block 180 may not perform the mura correction operation when the set (e.g., predetermined) pattern is detected by the pattern detection block 170. In a case where the mura correction operation is not performed, the temperature of the controller 160 may decrease or may not excessively increase (e.g., increase above a temperature criterion for the controller 160). Further, in some example embodiments, in the case where the mura correction operation is not performed, the temperature of the power management circuit 140 for providing the digital power supply voltage DVDD to the controller 160 also may decrease or may not excessively increase (e.g., increase above a temperature criterion for the power management circuit 140).

In some exemplary embodiments, the set (e.g., predetermined) pattern may be a two-horizontal dot (2H DOT) pattern. For example, as illustrated in FIG. 5, with respect to first through fourth pixels PX1 through PX4 (first pixel PX1, second pixel PX2, third pixel PX3, and fourth pixel PX4) sequentially arranged in a horizontal direction (e.g., a direction of a gate line) or first through twelfth sub-pixels (e.g., red, green and blue sub-pixels included in each of the first through fourth pixels PX1 through PX4) sequentially arranged in the horizontal direction, the set (e.g., predetermined) pattern or the two-horizontal dot pattern 200 may include high gray data HGD for the first through sixth sub-pixels and low gray data LGD for the seventh through twelfth sub-pixels. Further, in some exemplary embodiments, the high gray data HGD may be image data representing a gray level higher than or equal to a reference gray level, and the low gray data LGD may be image data representing a gray level lower than the reference gray level. For example, in a case where the reference gray level is 20-gray level, the input image data IDAT for the first through sixth sub-pixels represent gray levels higher than or equal to the 20-gray level, and the input image data IDAT for the seventh through twelfth sub-pixels represent gray levels lower than the 20-gray level. In some exemplary embodiments, the pattern detection block 170 may determine the input image data IDAT for the first through twelfth sub-pixels as the set (e.g., predetermined) pattern or the two-horizontal dot pattern 200.

In some exemplary embodiments, the pattern detection block 170 may control the mura correction block 180 to not perform the mura correction operation when a size or number of the set (e.g., predetermined) pattern(s) detected in the input image data IDAT for one frame is greater than or equal to a reference size or number. For example, the pattern detection block 170 may generate a mura correction control signal MCCS having a first level when the input image data IDAT correspond to the set (e.g., predetermined) pattern with respect to a number of the pixels PX that is less than a reference pixel number, and may generate the mura correction control signal MCCS having a second level when the input image data IDAT correspond to the set (e.g., predetermined) pattern with respect to the number of the pixels PX that is greater than or equal to the reference pixel number. The mura correction block 180 may perform the mura correction operation while the mura correction control signal MCCS has the first level, and may not perform the mura correction operation while the mura correction control signal MCCS has the second level.

FIG. 6 illustrates an example where the display panel 110 may include 2,560*1,080 pixels PX, and the mura correction operation is not performed in a case where a size (e.g., 2H DOT PATTERN SIZE) of the set (e.g., predetermined) pattern is greater than or equal to a size corresponding to 2,160 (e.g., HORIZONTAL)*840 (e.g., VERTICAL) pixels PX. Thus, in an example embodiment of FIG. 6, in a case where the two-horizontal dot pattern 200 including the high gray data HGD for the first and second pixels PX1 and PX2 and the low gray data LGD for the third and fourth pixels PX3 and PX4 with respect to the first through fourth pixels PX1, PX2, PX3 and PX4 sequentially arranged in the horizontal direction is detected more than or equal to (2,160*840)/4 times in a current frame, the mura correction operation may not be performed in the next frame. Further, in a case where the two-horizontal dot pattern 200 is detected less than (2,160*840)/4 times in a current frame, the mura correction operation may be performed in the next frame. For example, in a case where the two-horizontal dot pattern 200 is detected more than or equal to (2,160*840)/4 times in a first frame, and the two-horizontal dot pattern 200 is detected less than (2,160*840)/4 times in a second frame subsequent to the first frame, the mura correction operation may not be performed in the second frame, and the mura correction operation may be performed in a third frame subsequent to the second frame. As illustrated in FIG. 6, in a case where the mura correction operation is unconditionally or always performed, a temperature TEMPERATURE (MURA CORRECTION) of the controller 160 may increase as a size or the number of the two-horizontal dot patterns 200 detected in the input image data IDAT for one frame increases. The two-horizontal dot pattern 200 may require relatively great calculations or processes by the controller (e.g., compared with a white pattern or a black pattern where the input image data IDAT for the plurality of pixels PX represent a constant gray level). Accordingly, as the size or the number of the two-horizontal dot patterns 200 increases, a calculation amount or a process amount of the controller 160 may increase, and thus the temperature of the controller 160 may increase. For example, the temperature of the controller 160 may be about 96.2 degrees in a case where the input image data IDAT have the two-horizontal dot pattern 200 with respect to 1,660*540 pixels PX and have any pattern (e.g., the white pattern or the black pattern) other than the two-horizontal dot pattern 200 with respect to the remaining pixels PX (i.e., pixels PX not including the 1,660*540 pixels PX having the two-horizontal dot pattern 200). However, the temperature of the controller 160 may be about 109.5 degrees in a case where the input image data IDAT have the two-horizontal dot pattern 200 with respect to all of the pixels PX or, in this case, 2,560*1,080 pixels PX as illustrated in FIG. 6. Further, in a case where the temperature of the controller 160 is higher than or equal to a set (e.g., predetermined) temperature criterion (e.g., a heating temperature criterion or specification of about 103.5 degrees), the display device 100 may be damaged or not operate normally (e.g., operate as desired). However, in the display device 100 according to exemplary embodiments, the pattern detection block 170 may generate the mura correction control signal MCCS having the second level in a case where the input image data IDAT have the set (e.g., predetermined) pattern with respect to the reference pixel number of pixels PX or more, for example, about 2,160*840 pixels PX, and the mura correction block 180 may not perform the mura correction operation while the mura correction control signal MCCS has the second level. Accordingly, as illustrated in FIG. 6, if the input image data IDAT correspond to the set (e.g., predetermined) pattern with respect to the reference pixel number of pixels PX or more, the mura correction operation may not be performed, and therefore, the temperature TEMPERATURE(SELECTIVE MURA CORRECTION) of the controller 160 may be reduced compared with a case where the mura correction operation is performed (e.g., the temperature of the controller 160 may decrease to about 96.6 degrees as illustrated in FIG. 6 if the temperature of the controller 160 is above about 96.6 degrees). Thus, the abnormal operation and the damage of the display device 100 may be prevented or substantially prevented (e.g., prevented by not exceeding the temperature heating criterion or specification). Although FIG. 6 illustrates an example where the mura correction operation is not performed in the case where the input image data IDAT represent the set (e.g., predetermined) pattern having a size corresponding to the 2,160*840 pixels PX, or represent (2,160*840)/4 two-horizontal dot patterns 200, the size or number of the set (e.g., predetermined) pattern(s) or the number of the two-horizontal dot patterns 200 for not performing the mura correction operation is not limited to the example of FIG. 6, and may be suitably changed according to various driving environments/conditions, such as, for example, a size or a resolution of the display panel 110, specifications of driving devices (e.g., the controller 160, the power management circuit 140, the data driver 130 and/or the gate driver 120), and a specification of the display panel 110, etc. For example, as the size of the display panel 110 increases, the size or number of the set (e.g., predetermined) pattern(s) or the number of the two-horizontal dot patterns 200 for not performing the mura correction operation may be increased.

In some example embodiments, the mura correction block is configured not to perform the mura correction operation in a case where the size or number of the set (e.g., predetermined) pattern(s) is greater than or equal to the reference size or number, or in a case where the input image data IDAT correspond to the set (e.g., predetermined) pattern with respect to the reference pixel number (e.g., 2,160*840 in the example of FIG. 6) of pixels PX or more, the pattern detection block 170 may count the number of the set (e.g., predetermined) patterns in the input image data IDAT for one frame. Further, the pattern detection block 170 may generate the mura correction control signal MCCS having the first level when the counted number of the set (e.g., predetermined) patterns is less than a reference pattern number (e.g., (2,160*840)/4 in the example of FIGS. 5 and 6), and may generate the mura correction control signal MCCS having the second level when the counted number of the set (e.g., predetermined) patterns is greater than or equal to the reference pattern number. The mura correction block 180 may perform the mura correction operation while the mura correction control signal MCCS has the first level, and may not perform the mura correction operation while the mura correction control signal MCCS has the second level.

Although FIGS. 5 and 6 illustrate an example where the set (e.g., predetermined) pattern is the two-horizontal dot pattern, the set (e.g., predetermined) pattern according to example embodiments is not limited to the two-horizontal dot pattern. In some exemplary embodiments, when the display device 100 is manufactured, a plurality of input image data IDAT respectively for a plurality of patterns may be provided to the display device 100, and at least one of the plurality of patterns which makes a temperature of the components (e.g., the controller 160 and/or the power management circuit 140) of the display device 100 become greater than or equal to the set (e.g., predetermined) temperature criterion may be determined as the set (e.g., predetermined) pattern detected by the pattern detection block 170. For example, as illustrated in FIG. 7, when the input image data IDAT having a white pattern corresponding to a white image are provided to the display device 100, the temperature of the controller 160 may be about 87.2 degrees, and the temperature of the power management circuit 140 may be about 81.8 degrees. When the input image data IDAT having a color bar pattern corresponding to an image including different color (e.g., red, green and blue) bars extending in a vertical direction are provided to the display device 100, the temperature of the controller 160 may be about 89.4 degrees, and the temperature of the power management circuit 140 may be about 85.7 degrees. When the input image data IDAT having the two-horizontal dot pattern corresponding to an image where a high gray dot and a low gray dot are alternated per two pixels PX along the horizontal direction are provided to the display device 100, the temperature of the controller 160 may be about 109.5 degrees, and the temperature of the power management circuit 140 may be about 91.1 degrees. When the input image data IDAT having a horizontal stripe pattern corresponding to an image where a high gray stripe extending in the horizontal direction and a low gray stripe extending in the horizontal direction are alternated along the vertical direction are provided to the display device 100, the temperature of the controller 160 may be about 90.4 degrees, and the temperature of the power management circuit 140 may be about 88.2 degrees. When the input image data IDAT having a checker pattern corresponding to an image where a high gray dot and a low gray dot are alternated per one pixel PX along the horizontal direction and along the vertical direction are provided to the display device 100, the temperature of the controller 160 may be about 96.2 degrees, and the temperature of the power management circuit 140 may be about 91.9 degrees. Further, in a case where the temperature criterion for the controller 160 is about 103.5 degrees, and the temperature criterion for the power management circuit 140 is about 106.7 degrees, the two-horizontal dot pattern may make the temperature of the controller 160 become about 109.5 degrees, which is greater than the temperature criterion of about 103.5 degrees. Accordingly, because the two-horizontal dot pattern may cause the temperature of the controller 160 to exceed the temperature criterion for the controller 160, the two-horizontal dot pattern may be determined as the set (e.g., predetermined) pattern detected by the pattern detection block 170. Although FIG. 7 illustrates an example where the two-horizontal dot pattern is determined as the set (e.g., predetermined) pattern detected by the pattern detection block 170, the set (e.g., predetermined) pattern detected by the pattern detection block 170 is not limited to the two-horizontal dot pattern. For example, the set (e.g., predetermined) pattern detected by the pattern detection block 170 may be changed or varied according to a model, a size, etc. of the display device 100. Further, in some exemplary embodiments, the pattern detection block 170 may detect two or more set (e.g., predetermined) patterns.

As described above, in the display device 100 according to exemplary embodiments, the pattern detection block 170 may detect the set (e.g., predetermined) pattern in the input image data IDAT, and the mura correction block 180 may not perform the mura correction operation when the set (e.g., predetermined) pattern is detected. Accordingly, the temperature of the controller 160 and/or the power management circuit 140 of the display device 100 may be prevented or substantially prevented from being excessively increased (e.g., increased above a temperature criterion for the controller 160 and/or the power management circuit 140) by the mura correction operation, and thus the abnormal operation and the damage of the display device 100 may be prevented or substantially prevented.

Figure 8:
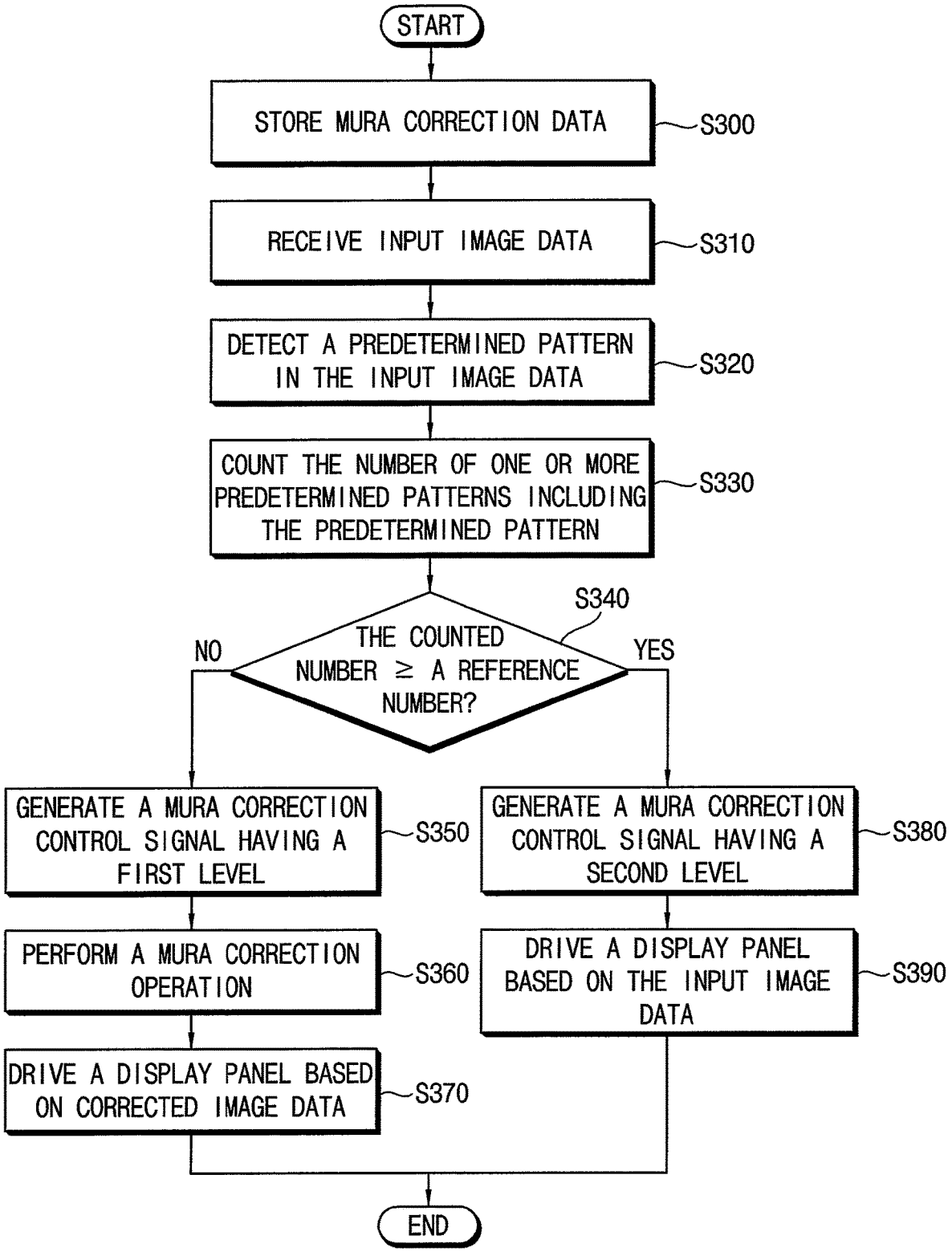
FIG. 8 is a flowchart illustrating a method of operating a display device according to exemplary embodiments.

FIG. 8 is a flowchart illustrating a method of operating a display device according to exemplary embodiments.

Referring to FIGS. 1 and 8, in a method of operating a display device 100, mura correction data MCD may be stored in a correction data memory 150 (e.g., when the display device 100 is manufactured) (S300). A controller 160 may receive input image data IDAT (S310), and a pattern detection block 170 may detect a set (e.g., predetermined) pattern in the input image data IDAT (S320). Further, the pattern detection block 170 may count the number of one or more set (e.g., predetermined) patterns including the set (e.g., predetermined) pattern in the input image data IDAT for one frame (S330).

In a case where the counted number of the one or more set (e.g., predetermined) patterns is less than a reference pattern number (S340: NO), the pattern detection block 170 may generate a mura correction control signal MCCS having a first level (S350), and a mura correction block 180 may perform a mura correction operation that generates corrected image data CDAT by correcting the input image data IDAT based on the mura correction data MCD while the mura correction control signal MCCS has the first level (S360). A data driver 130 may receive the corrected image data CDAT from the controller 160, and may drive a display panel 110 based on the corrected image data CDAT (S370).

In a case where the counted number of the one or more set (e.g., predetermined) patterns is greater than or equal to the reference pattern number (S340: YES), the pattern detection block 170 may generate the mura correction control signal MCCS having a second level (S380), and the mura correction block 180 may not perform the mura correction operation while the mura correction control signal MCCS has the second level. Because the mura correction operation is not performed, a temperature of the controller 160 and/or a power management circuit 140 may be reduced (compared with a case where the mura correction operation is performed). Further, the data driver 130 may receive not the corrected image data CDAT, but the input image data IDAT from the controller 160, and may drive the display panel 110 based on the input image data IDAT (S390).

As described above, in the display device 100 according to exemplary embodiments, the set (e.g., predetermined) pattern may be detected in the input image data IDAT, and the mura correction operation may not be performed when the set (e.g., predetermined) pattern is detected (e.g., the counted number of the one or more set (e.g., predetermined) patterns is greater than or equal to the reference pattern number). Accordingly, the temperature of the controller 160 and/or the power management circuit 140 may be prevented or substantially prevented from being excessively increased (e.g., increased above a temperature criterion for the controller 160 and/or the power management circuit 140) by the mura correction operation, and thus an abnormal operation and a damage of the display device 100 may be prevented or substantially prevented.

Figure 9:
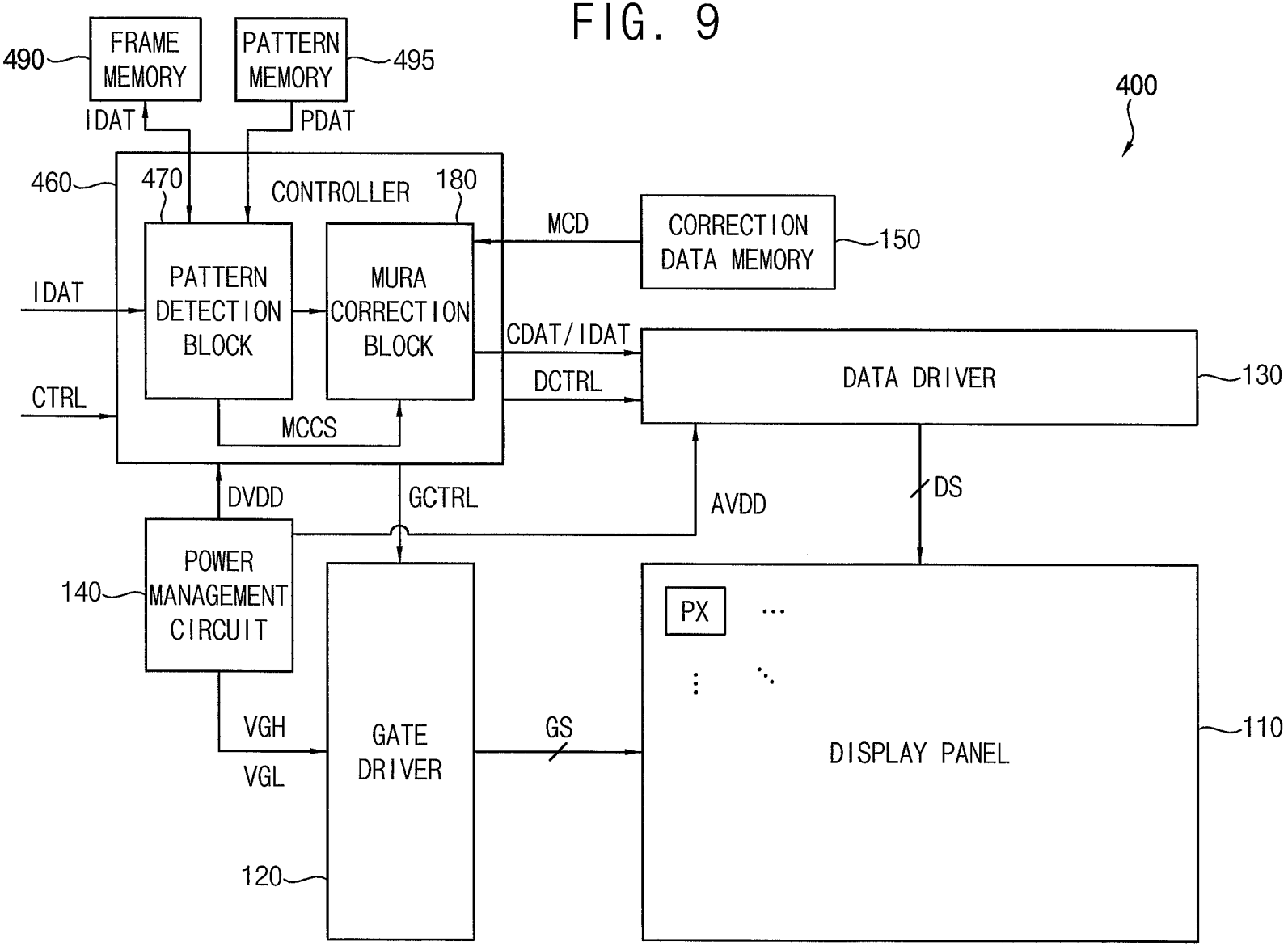
FIG. 9 is a block diagram illustrating a display device according to exemplary embodiments.

FIG. 9 is a block diagram illustrating a display device according to exemplary embodiments.

Referring to FIG. 9, a display device 400 according to exemplary embodiments may include a display panel 110, a gate driver 120, a data driver 130, a power management circuit 140, a correction data memory 150, a controller 460, a frame memory 490 and a pattern memory 495. In some exemplary embodiments, the controller 460 may include a pattern detection block 470 and a mura correction block 180. The display device 400 of FIG. 9 may have substantially the same configuration and substantially the same operation as a display device 100 of FIG. 1, except that the pattern detection block 470 may detect a set (e.g., predetermined) pattern by using the frame memory 490 and the pattern memory 495.

The pattern memory 495 may store pattern data PDAT having the set (e.g., predetermined) pattern (e.g., a two-horizontal dot pattern). For example, when the display device 400 is manufactured, the pattern data PDAT may be written to the pattern memory 495. Further, the pattern memory 495 may store the pattern data PDAT for one frame.

The controller 460 may store input image data IDAT for one frame in the frame memory 490. If the input image data IDAT for the one frame are stored in the frame memory 490, the pattern detection block 470 may detect the set (e.g., predetermined) pattern in the input image data IDAT by comparing the input image data IDAT stored in the frame memory 490 and the pattern data PDAT stored in the pattern memory 495. In some exemplary embodiments, the pattern detection block 470 may generate a mura correction control signal MCCS having a second level when a size of the detected set (e.g., predetermined) pattern is greater than or equal to a reference size, and the mura correction block 180 may not perform a mura correction operation while the mura correction control signal MCCS has the second level. Accordingly, a temperature of the controller 460 and/or the power management circuit 140 may be prevented or substantially prevented from being excessively increased (e.g., increased above a temperature criterion for the controller 460 and/or the power management circuit 140) by the mura correction operation, and thus an abnormal operation and a damage of the display device 400 may be prevented or substantially prevented.

Figure 10:
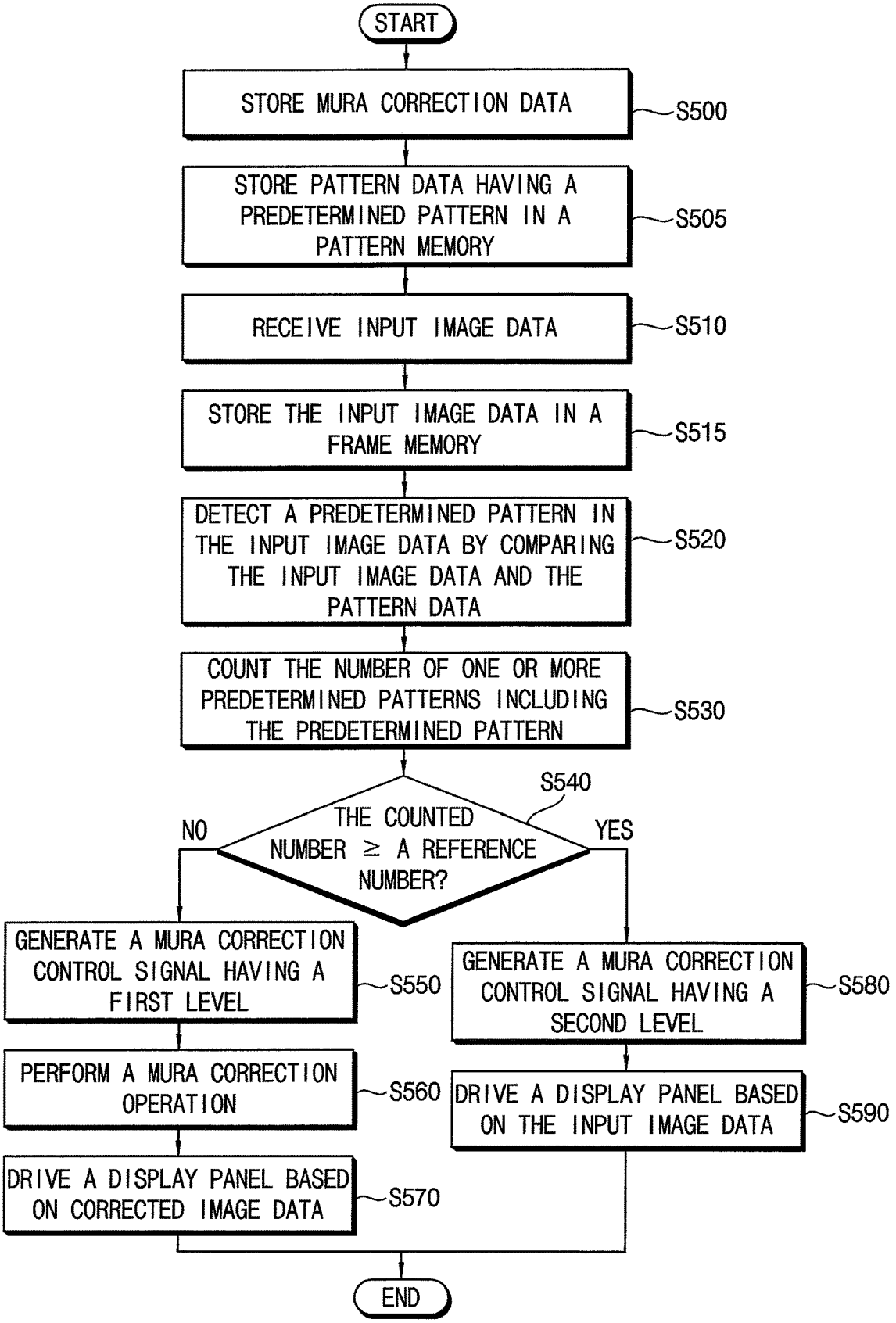
FIG. 10 is a flowchart illustrating a method of operating a display device according to exemplary embodiments.

FIG. 10 is a flowchart illustrating a method of operating a display device according to exemplary embodiments.

Referring to FIGS. 9 and 10, in a method of operating a display device 400 (e.g., when the display device 400 is manufactured), mura correction data MCD may be stored in a correction data memory 150 (S500), and pattern data PDAT having the set (e.g., predetermined) pattern (e.g., a two-horizontal dot pattern) may be stored in a pattern memory 495 (S505). A controller 460 may receive input image data IDAT (S510), and may store the input image data IDAT for one frame in a frame memory 490 (S515). A pattern detection block 470 may detect a set (e.g., predetermined) pattern in the input image data IDAT by comparing the input image data IDAT stored in the frame memory 490 and the pattern data PDAT stored in the pattern memory 495 (S520). Further, the pattern detection block 470 may count the number of one or more set (e.g., predetermined) patterns including the set (e.g., predetermined) pattern in the input image data IDAT for the one frame (S530).

In a case where the counted number of the one or more set (e.g., predetermined) patterns is less than a reference pattern number (S540: NO), the pattern detection block 470 may generate a mura correction control signal MCCS having a first level (S550), and a mura correction block 180 may perform a mura correction operation that generates corrected image data CDAT by correcting the input image data IDAT based on the mura correction data MCD while the mura correction control signal MCCS has the first level (S560). A data driver 130 may receive the corrected image data CDAT from the controller 460, and may drive a display panel 110 based on the corrected image data CDAT (S570).

In a case where the counted number of the one or more set (e.g., predetermined) patterns is greater than or equal to the reference pattern number (S540: YES), the pattern detection block 470 may generate the mura correction control signal MCCS having a second level (S580), and the mura correction block 180 may not perform the mura correction operation while the mura correction control signal MCCS has the second level. Because the mura correction operation is not performed, a temperature of the controller 460 and/or a power management circuit 140 may be reduced (compared with a case where the mura correction operation is performed), and an abnormal operation and a damage of the display device 400 may be prevented or substantially prevented. Further, the data driver 130 may receive the input image data IDAT instead of the corrected image data CDAT from the controller 460, and may drive the display panel 110 based on the input image data IDAT (S590).

Figure 11:
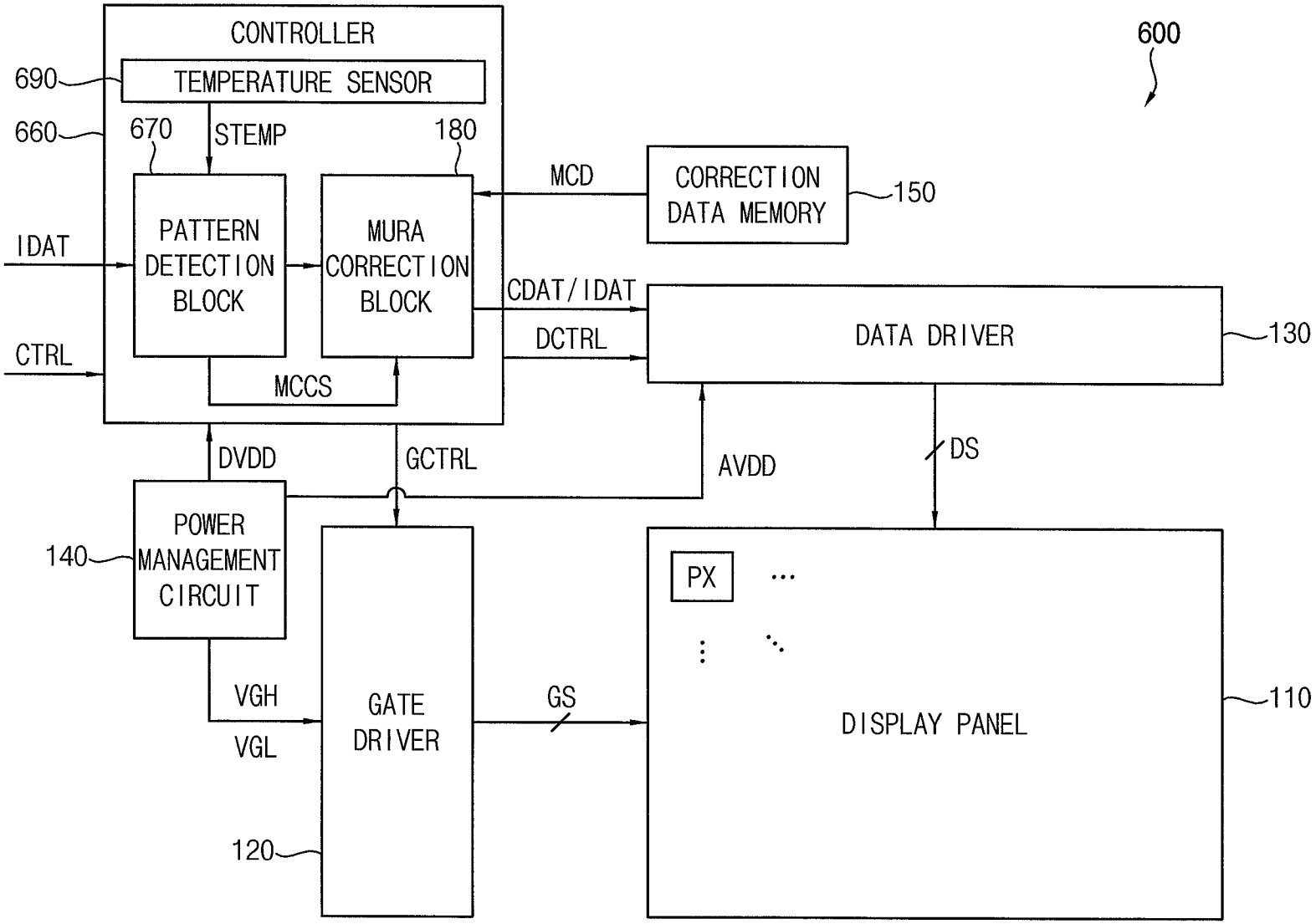
FIG. 11 is a block diagram illustrating a display device according to exemplary embodiments.

FIG. 11 is a block diagram illustrating a display device according to exemplary embodiments.

Referring to FIG. 11, a display device 600 according to exemplary embodiments may include a display panel 110, a gate driver 120, a data driver 130, a power management circuit 140, a correction data memory 150 and a controller 660. In some exemplary embodiments, the controller 660 may include a pattern detection block 670, a mura correction block 180 and a temperature sensor 690. The display device 600 of FIG. 11 may have substantially the same configuration and substantially the same operation as a display device 100 of FIG. 1, except that the controller 660 may further include the temperature sensor 690, and a mura correction operation may be selectively performed according to not only whether a set (e.g., predetermined) pattern is detected, but also whether a temperature sensed by the temperature sensor 690 is greater than or equal to a reference temperature.

The temperature sensor 690 may sense a temperature of the controller 660, and may provide a temperature signal STEMP representing the sensed temperature to the pattern detection block 670. Although FIG. 11 illustrates an example where the temperature sensor 690 is included in the controller 660, in other exemplary embodiments, the temperature sensor 690 may be included in the power management circuit 140, and may sense a temperature of the power management circuit 140. In still other exemplary embodiments, the temperature sensor 690 may be included in each of the controller 660 and the power management circuit 140. In still other exemplary embodiments, the temperature sensor 690 may be located outside the controller 660 and the power management circuit 140.

The pattern detection block 670 may control the mura correction block 180 to not perform the mura correction operation in a case where the temperature sensed by the temperature sensor 690 is greater than or equal to the reference temperature and the set (e.g., predetermined) pattern (e.g., having a size greater than or equal to a reference size, or having the number greater than or equal to a reference pattern number) is detected in input image data IDAT. For example, the reference temperature may be lower than a temperature criterion of about 103.5 degrees for determining the set (e.g., predetermined) pattern illustrated in FIG. 7, but is not limited thereto. In some exemplary embodiments, the pattern detection block 670 may count the number of one or more set (e.g., predetermined) patterns including the set (e.g., predetermined) pattern in the input image data IDAT for one frame, may compare the temperature of the controller 660 sensed by the temperature sensor 690 with the reference temperature, may generate a mura correction control signal MCCS having a first level when the counted number of the one or more set (e.g., predetermined) patterns is less than the reference pattern number or when the temperature of the controller 660 is less than the reference temperature, and may generate the mura correction control signal MCCS having a second level when the counted number of the one or more set (e.g., predetermined) patterns is greater than or equal to the reference pattern number and when the temperature of the controller 660 is greater than or equal to the reference temperature. The mura correction block 180 may perform the mura correction operation while the mura correction control signal MCCS has the first level, and may not perform the mura correction operation while the mura correction control signal MCCS has the second level. Accordingly, a temperature of the controller 660 and/or the power management circuit 140 may be prevented or substantially prevented from being excessively increased (e.g., increased above a temperature criterion for the controller 660 and/or the power management circuit 140) by the mura correction operation, and thus an abnormal operation and a damage of the display device 600 may be prevented or substantially prevented.

Figure 12:
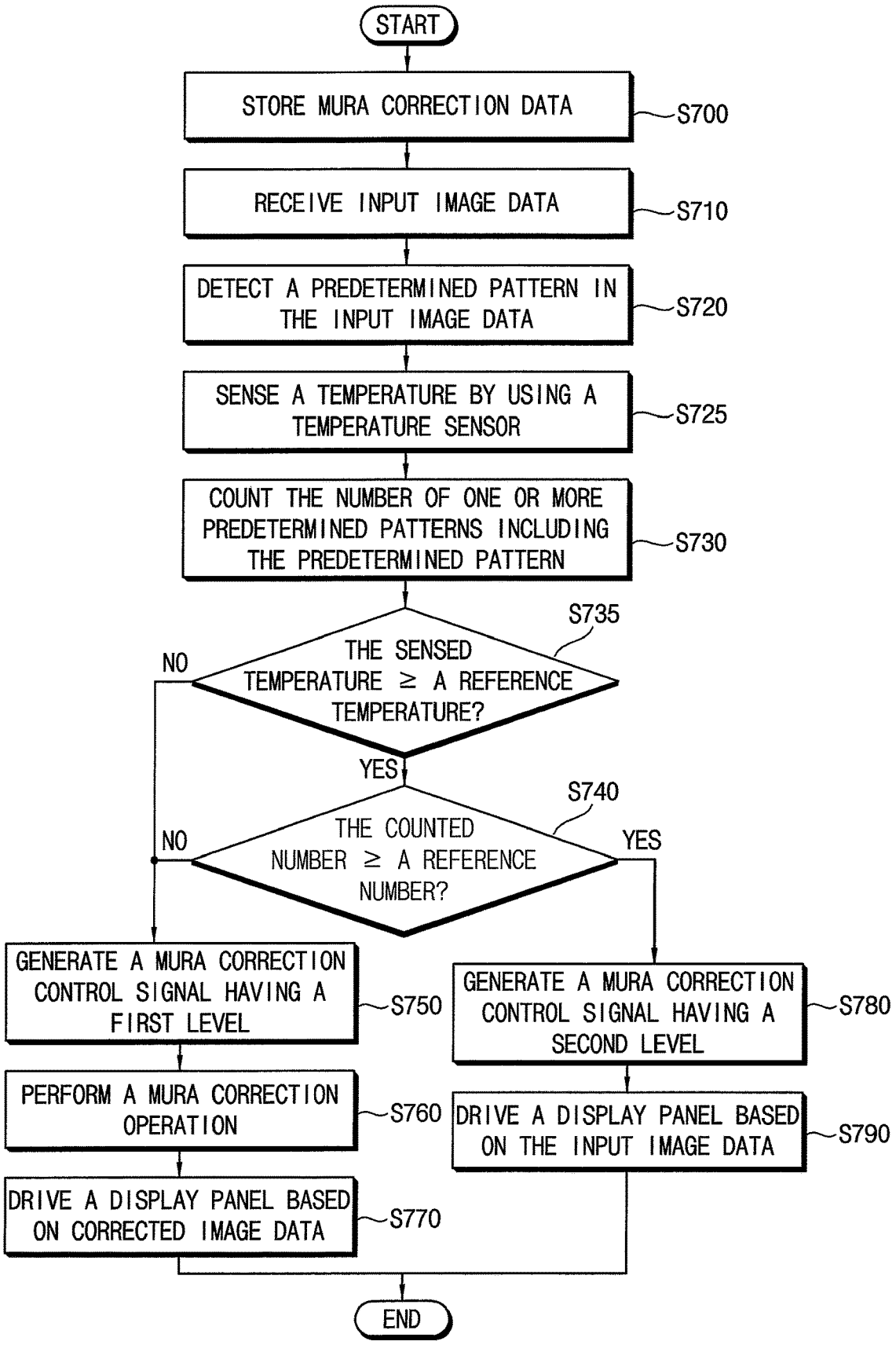
FIG. 12 is a flowchart illustrating a method of operating a display device according to exemplary embodiments.

FIG. 12 is a flowchart illustrating a method of operating a display device according to exemplary embodiments.

Referring to FIGS. 11 and 12, in a method of operating a display device 600, mura correction data MCD may be stored in a correction data memory 150 (e.g., when the display device 600 is manufactured) (S700). A controller 660 may receive input image data IDAT (S710), and a pattern detection block 670 may detect a set (e.g., predetermined) pattern in the input image data IDAT (S720). A temperature sensor 690 may sense a temperature of the controller 660 and/or a power management circuit 140 (S725). Further, the pattern detection block 670 may count the number of one or more set (e.g., predetermined) patterns including the set (e.g., predetermined) pattern in the input image data IDAT for one frame (S730).

In a case where the temperature sensed by the temperature sensor 690 is less than a reference temperature (S735: NO) or in a case where the counted number of the one or more set (e.g., predetermined) patterns is less than a reference pattern number (S740: NO), the pattern detection block 670 may generate a mura correction control signal MCCS having a first level (S750), and a mura correction block 180 may perform a mura correction operation that generates corrected image data CDAT by correcting the input image data IDAT based on the mura correction data MCD while the mura correction control signal MCCS has the first level (S760). A data driver 130 may receive the corrected image data CDAT from the controller 660, and may drive a display panel 110 based on the corrected image data CDAT (S770).

In a case where the temperature sensed by the temperature sensor 690 is greater than or equal to the reference temperature (S735: YES) and in a case where the counted number of the one or more set (e.g., predetermined) patterns is greater than or equal to the reference pattern number (S740: YES), the pattern detection block 670 may generate the mura correction control signal MCCS having a second level (S780), and the mura correction block 180 may not perform the mura correction operation while the mura correction control signal MCCS has the second level. Because the mura correction operation is not performed, the temperature of the controller 660 and/or the power management circuit 140 may be reduced (compared with a case where the mura correction operation is performed), and an abnormal operation and a damage of the display device 600 may be prevented or substantially prevented. Further, the data driver 130 may receive not the corrected image data CDAT, but the input image data IDAT from the controller 660, and may drive the display panel 110 based on the input image data IDAT (S790).

Figure 13:
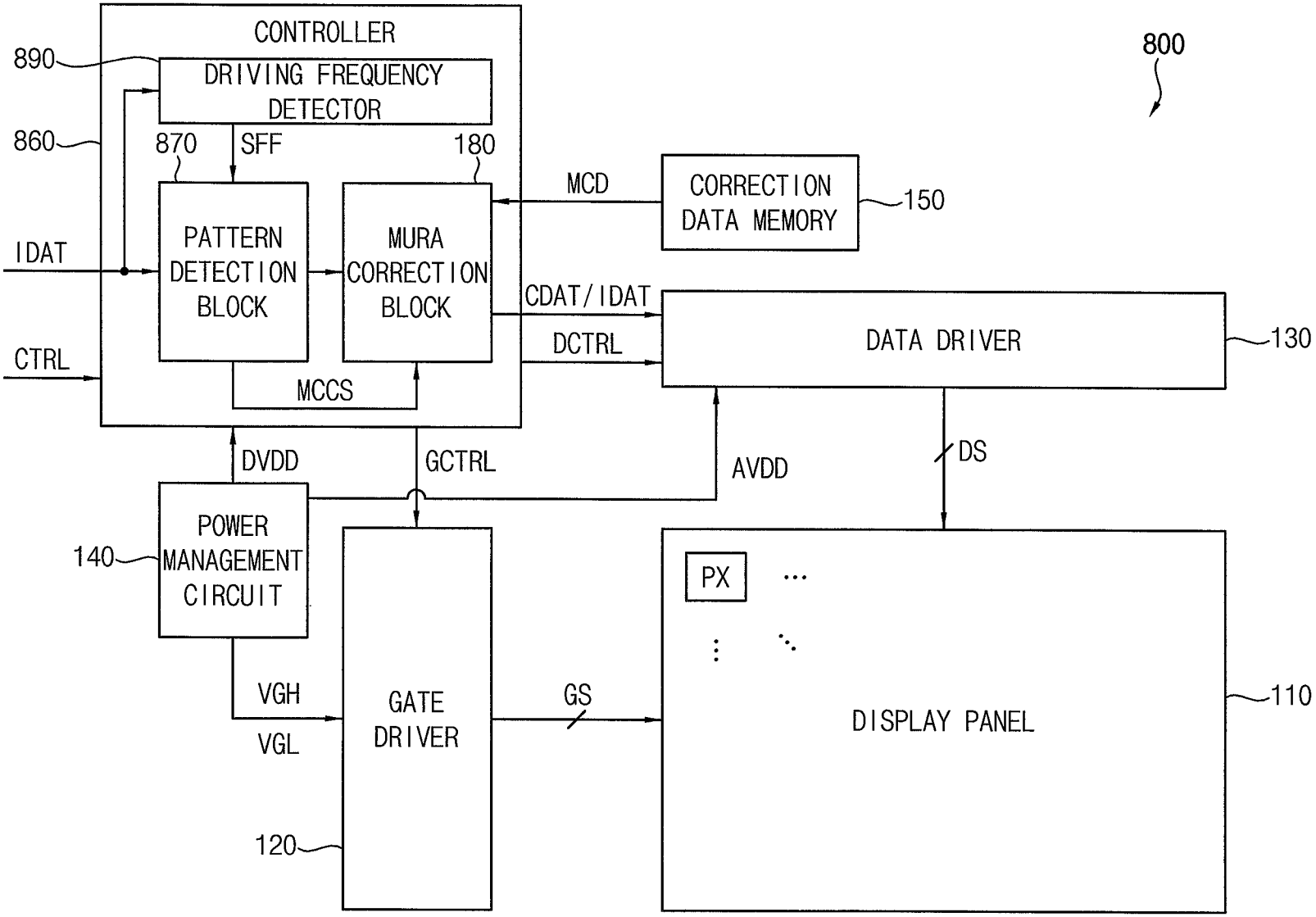
FIG. 13 is a block diagram illustrating a display device according to exemplary embodiments.

FIG. 13 is a block diagram illustrating a display device according to exemplary embodiments.

Referring to FIG. 13, a display device 800 according to exemplary embodiments may include a display panel 110, a gate driver 120, a data driver 130, a power management circuit 140, a correction data memory 150 and a controller 860. In some exemplary embodiments, the controller 860 may include a pattern detection block 870, a mura correction block 180 and a driving frequency detector 890. The display device 800 of FIG. 13 may have substantially the same configuration and substantially the same operation as a display device 100 of FIG. 1, except that the controller 860 may further include the driving frequency detector 890, and a mura correction operation may be selectively performed according to not only whether a set (e.g., predetermined) pattern is detected, but also whether a frame frequency of input image data IDAT is greater than or equal to a reference frequency.

The driving frequency detector 890 may detect the frame frequency of the input image data IDAT, and may provide a frame frequency signal SFF representing the frame frequency of the input image data IDAT to the pattern detection block 870. In some exemplary embodiments, the driving frequency detector 890 may detect the frame frequency of the input image data IDAT by measuring a time interval between adjacent vertical synchronization signals, but is not limited thereto.

The pattern detection block 870 may control the mura correction block 180 to not perform the mura correction operation in a case where the frame frequency detected by the driving frequency detector 890 is greater than or equal to the reference frequency and the set (e.g., predetermined) pattern (e.g., having a size greater than or equal to a reference size, or having the number greater than or equal to a reference pattern number) is detected in the input image data IDAT. In some exemplary embodiments, the pattern detection block 870 may count the number of one or more set (e.g., predetermined) patterns including the set (e.g., predetermined) pattern in the input image data IDAT for one frame, may compare the frame frequency detected by the driving frequency detector 890 with the reference frequency, may generate a mura correction control signal MCCS having a first level when the counted number of the one or more set (e.g., predetermined) patterns is less than the reference pattern number or when the frame frequency is less than the reference frequency, and may generate the mura correction control signal MCCS having a second level when the counted number of the one or more set (e.g., predetermined) patterns is greater than or equal to the reference pattern number and when the frame frequency is greater than or equal to the reference frequency. The mura correction block 180 may perform the mura correction operation while the mura correction control signal MCCS has the first level, and may not perform the mura correction operation while the mura correction control signal MCCS has the second level. Accordingly, a temperature of the controller 860 and/or the power management circuit 140 may be prevented or substantially prevented from being excessively increased (e.g., increased above a temperature criterion for the controller 860 and/or the power management circuit 140) by the mura correction operation, and thus an abnormal operation and a damage of the display device 800 may be prevented or substantially prevented.

Figure 14:
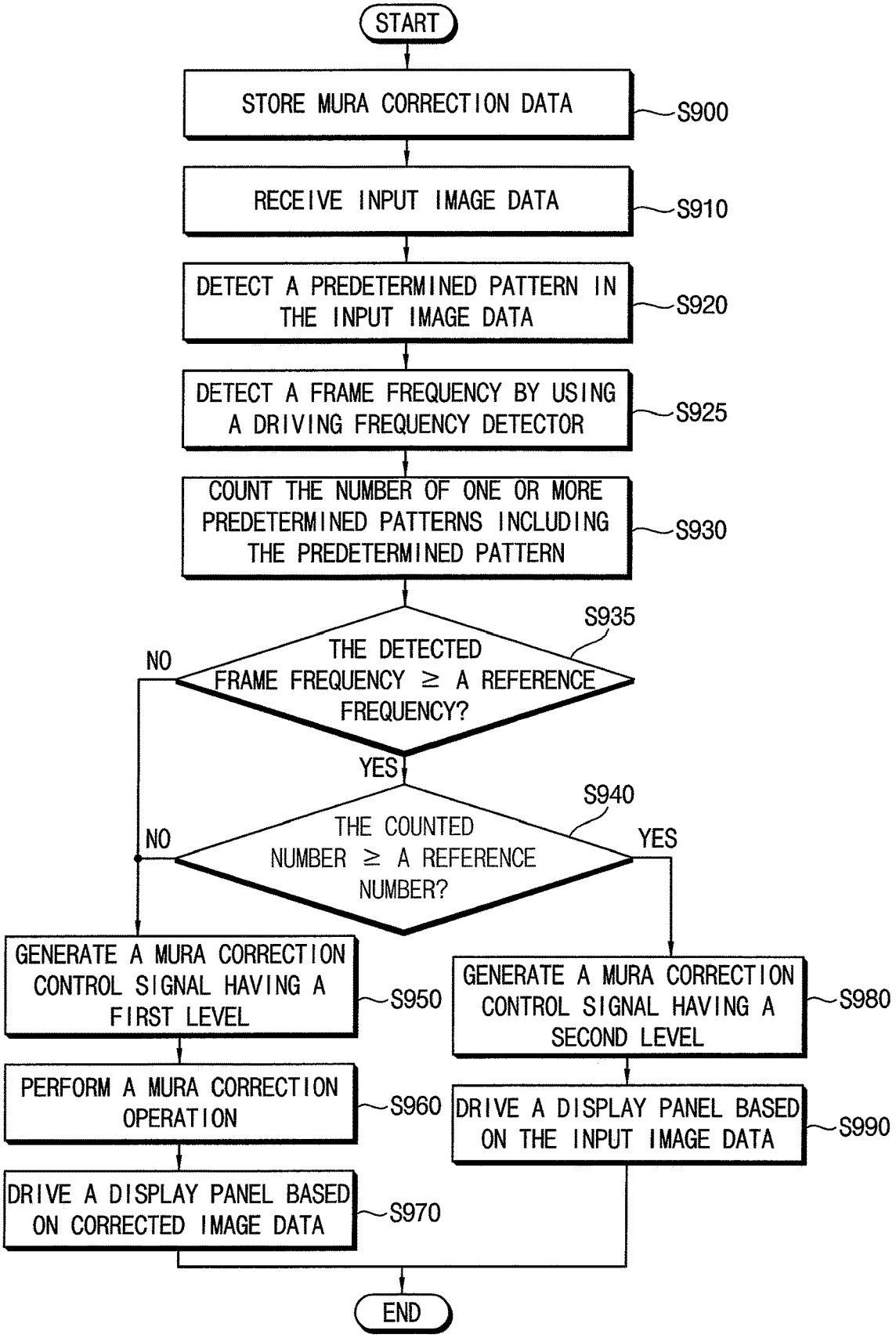
FIG. 14 is a flowchart illustrating a method of operating a display device according to exemplary embodiments.

FIG. 14 is a flowchart illustrating a method of operating a display device according to exemplary embodiments.

Referring to FIGS. 13 and 14, in a method of operating a display device 800, mura correction data MCD may be stored in a correction data memory 150 (e.g., when the display device 800 is manufactured) (S900). A controller 860 may receive input image data IDAT (S910), and a pattern detection block 870 may detect a set (e.g., predetermined) pattern in the input image data IDAT (S920). A driving frequency detector 890 may detect a frame frequency of the input image data IDAT (S925). Further, the pattern detection block 870 may count the number of one or more set (e.g., predetermined) patterns including the set (e.g., predetermined) pattern in the input image data IDAT for one frame (S930).

In a case where the frame frequency detected by the driving frequency detector 890 is less than a reference frequency (S935: NO) or in a case where the counted number of the one or more set (e.g., predetermined) patterns is less than a reference pattern number (S940: NO), the pattern detection block 870 may generate a mura correction control signal MCCS having a first level (S950), and a mura correction block 180 may perform a mura correction operation that generates corrected image data CDAT by correcting the input image data IDAT based on the mura correction data MCD while the mura correction control signal MCCS has the first level (S960). A data driver 130 may receive the corrected image data CDAT from the controller 860, and may drive a display panel 110 based on the corrected image data CDAT (S970).

In a case where the frame frequency detected by the driving frequency detector 890 is greater than or equal to the reference frequency (S935: YES) and in a case where the counted number of the one or more set (e.g., predetermined) patterns is greater than or equal to the reference pattern number (S940: YES), the pattern detection block 870 may generate the mura correction control signal MCCS having a second level (S980), and the mura correction block 180 may not perform the mura correction operation while the mura correction control signal MCCS has the second level. Because the mura correction operation is not performed, a temperature of the controller 860 and/or a power management circuit 140 may be reduced (compared with a case where the mura correction operation is performed), and an abnormal operation and a damage of the display device 800 may be prevented or substantially prevented. Further, the data driver 130 may receive the input image data IDAT instead of the corrected image data CDAT from the controller 860, and may drive the display panel 110 based on the input image data IDAT (S990).

Figure 15:
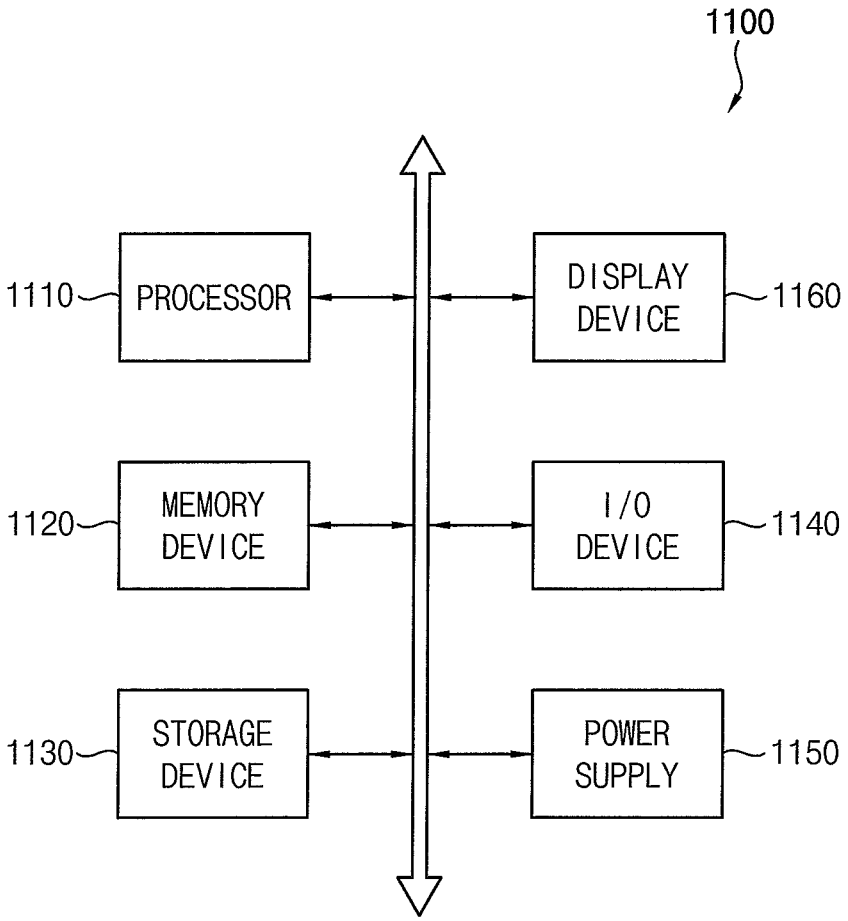
FIG. 15 is a block diagram illustrating an electronic device including a display device according to exemplary embodiments.

FIG. 15 is a block diagram illustrating an electronic device including a display device according to exemplary embodiments.

Referring to FIG. 15, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some exemplary embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In the display device 1160, a set (e.g., predetermined) pattern may be detected in input image data, and a mura correction operation may not be performed when the set (e.g., predetermined) pattern is detected. Accordingly, a temperature of a controller and/or a power management circuit of the display device 1160 may be prevented or substantially prevented from being excessively increased (e.g., increased above a temperature criterion for the controller and/or the power management circuit) by the mura correction operation, and thus an abnormal operation and a damage of the display device 1160 may be prevented or substantially prevented.

The inventive concepts may be applied to any display device 1160 performing the mura correction, and any electronic device 1100 including the display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims, and equivalents thereof.

What is claimed is:

1. A display device comprising:

a display panel comprising a plurality of pixels comprising a first pixel, a second pixel, a third pixel, and a fourth pixel sequentially arranged in a horizontal direction;

a gate driver configured to provide gate signals to the plurality of pixels;

a data driver configured to provide data signals to the plurality of pixels;

a correction data memory configured to store mura correction data; and a controller configured to control the gate driver and the data driver, the controller comprising:

a pattern detection circuit configured to detect a set pattern in input image data; and a mura correction circuit configured to perform a mura correction operation that corrects the input image data based on the mura correction data in response to the set pattern not being detected, and to not perform the mura correction operation in accordance with the set pattern being detected, wherein the set pattern comprises high gray data for the first pixel and the second pixel and low gray data for the third pixel and the fourth pixel.

2. The display device of claim 1, wherein the set pattern is a two-horizontal dot pattern.

3. The display device of claim 1, wherein the plurality of pixels comprises a first sub-pixel, a second sub-pixel, a third sub-pixel, a fourth sub-pixel, a fifth sub-pixel, a sixth sub-pixel, a seventh sub-pixel, an eighth sub-pixel, a ninth sub-pixel, a tenth sub-pixel, an eleventh sub-pixel, and a twelfth sub-pixel that are sequentially arranged in a horizontal direction, and wherein the set pattern comprises high gray data for the first sub-pixel, the second sub-pixel, the third sub-pixel, the fourth sub-pixel, the fifth sub-pixel, and the sixth sub-pixel and low gray data for the seventh sub-pixel, the eighth sub-pixel, the ninth sub-pixel, the tenth sub-pixel, the eleventh sub-pixel, and the twelfth sub-pixel.

4. The display device of claim 3, wherein the high gray data are image data representing a gray level higher than or equal to a reference gray level, and wherein the low gray data are image data representing a gray level lower than the reference gray level.

5. The display device of claim 1, wherein the pattern detection circuit is further configured to generate a mura correction control signal having a first level in response to the input image data corresponding to the set pattern with respect to a number of pixels from among the plurality of pixels that is less than a reference pixel number, and to generate the mura correction control signal having a second level in response to the input image data corresponding to the set pattern with respect to the number of pixels from among the plurality of pixels that is greater than or equal to the reference pixel number, and wherein the mura correction circuit is further configured to perform the mura correction operation in response to the mura correction control signal having the first level, and to not perform the mura correction operation in accordance with the mura correction control signal having the second level.

6. The display device of claim 1, wherein the pattern detection circuit is further configured to count a number of one or more set patterns comprising the set pattern in the input image data for one frame, to generate a mura correction control signal having a first level in response to the counted number of the one or more set patterns being less than a reference pattern number, and to generate the mura correction control signal having a second level in response to the counted number of the one or more set patterns being greater than or equal to the reference pattern number, and wherein the mura correction circuit is further configured to perform the mura correction operation in response to the mura correction control signal having the first level, and to not perform the mura correction operation in accordance with the mura correction control signal having the second level.

7. The display device of claim 1, wherein the mura correction data represent a plurality of correction values at a plurality of sampling gray levels, and wherein, with respect to each pixel, the mura correction circuit is further configured to perform the mura correction operation for the each pixel by linearly interpolating the plurality of correction values at two sampling gray levels from among the plurality of sampling gray levels, the two sampling gray levels being adjacent to a gray level of the input image data for the each pixel.

8. The display device of claim 1, wherein the mura correction data represent a plurality of correction values at a plurality of sampling positions, and wherein, with respect to each pixel, the mura correction circuit is further configured to perform the mura correction operation for the each pixel by performing a bilinear interpolation on the plurality of correction values at four sampling positions from among the plurality of sampling positions adjacent to the each pixel.

9. The display device of claim 1, wherein a temperature of the controller decreases in accordance with the mura correction operation not being performed.

10. The display device of claim 1, further comprising:

a power management circuit configured to provide a power supply voltage to the controller, wherein a temperature of the power management circuit decreases in accordance with the mura correction operation not being performed.

11. The display device of claim 1, further comprising:

a frame memory configured to store the input image data for one frame; and a pattern memory configured to store pattern data having the set pattern, wherein the pattern detection circuit is further configured to detect the set pattern in the input image data by comparing the input image data stored in the frame memory and the pattern data stored in the pattern memory.

12. The display device of claim 1, wherein the controller further comprises:

a temperature sensor configured to sense a temperature of the controller.

13. A display device comprising:

a display panel comprising a plurality of pixels;

a gate driver configured to provide gate signals to the plurality of pixels;

a data driver configured to provide data signals to the plurality of pixels;

a correction data memory configured to store mura correction data; and a controller configured to control the gate driver and the data driver, the controller comprising:

a pattern detection circuit configured to detect a set pattern in input image data;

a mura correction circuit configured to perform a mura correction operation that corrects the input image data based on the mura correction data in response to the set pattern not being detected, and to not perform the mura correction operation in accordance with the set pattern being detected; and a temperature sensor configured to sense a temperature of the controller, wherein the pattern detection circuit is further configured to:

count a number of one or more set patterns comprising the set pattern in the input image data for one frame;

compare the temperature of the controller sensed by the temperature sensor with a reference temperature;

generate a mura correction control signal having a first level in response to the counted number of the one or more set patterns being less than a reference pattern number or in response to the temperature of the controller being less than the reference temperature; and generate the mura correction control signal having a second level in response to the counted number of the one or more set patterns being greater than or equal to the reference pattern number and the temperature of the controller being greater than or equal to the reference temperature, and wherein the mura correction circuit is configured to perform the mura correction operation in response to the mura correction control signal having the first level, and to not perform the mura correction operation in accordance with the mura correction control signal having the second level.

14. The display device of claim 1, wherein the controller further comprises:

a driving frequency detection circuit configured to detect a frame frequency of the input image data.

15. A display device comprising:

a display panel comprising a plurality of pixels;

a gate driver configured to provide gate signals to the plurality of pixels;

a data driver configured to provide data signals to the plurality of pixels;

a correction data memory configured to store mura correction data; and a controller configured to control the gate driver and the data driver, the controller comprising:

a pattern detection circuit configured to detect a set pattern in input image data;

a mura correction circuit configured to perform a mura correction operation that corrects the input image data based on the mura correction data in response to the set pattern not being detected, and to not perform the mura correction operation in accordance with the set pattern being detected; and a driving frequency detection circuit configured to detect a frame frequency of the input image data, wherein the pattern detection circuit is further configured to:

count a number of one or more set patterns comprising the set pattern in the input image data for one frame;

compare the frame frequency detected by the driving frequency detection circuit with a reference frequency;

generate a mura correction control signal having a first level in response to the counted number of the one or more set patterns being less than a reference pattern number or in response to the frame frequency being less than the reference frequency; and generate the mura correction control signal having a second level in response to the counted number of the one or more set patterns being greater than or equal to the reference pattern number and the frame frequency being greater than or equal to the reference frequency, and wherein the mura correction circuit is configured to perform the mura correction operation in response to the mura correction control signal having the first level, and to not perform the mura correction operation in accordance with the mura correction control signal having the second level.

16. A method of operating a display device, the method comprising:

storing mura correction data;

receiving input image data;

detecting a set pattern in the input image data;

driving a display panel based on corrected image data by performing a mura correction operation that corrects the input image data based on the mura correction data in response to the set pattern not being detected; and driving the display panel based on the input image data without performing the mura correction operation in accordance with the set pattern being detected, wherein the display panel comprises a plurality of pixels comprising a first pixel, a second pixel, a third pixel, and a fourth pixel sequentially arranged in a horizontal direction, and wherein the set pattern comprises high gray data for the first pixel and the second pixel and low gray data for the third pixel and the fourth pixel.

17. The method of claim 16, further comprising:

counting a number of one or more set patterns comprising the set pattern in the input image data for one frame;

generating a mura correction control signal having a first level in response to the counted number of the one or more set patterns being less than a reference pattern number; and generating the mura correction control signal having a second level in response to the counted number of the one or more set patterns being greater than or equal to the reference pattern number, wherein the mura correction operation is performed in response to the mura correction control signal having the first level, and the mura correction operation is not performed in accordance with the mura correction control signal having the second level.

18. The method of claim 16, further comprising:

storing the input image data for one frame in a frame memory; and storing pattern data having the set pattern in a pattern memory, wherein detecting the set pattern in the input image data comprises detecting the set pattern in the input image data by comparing the input image data stored in the frame memory and the pattern data stored in the pattern memory.

19. The method of claim 16, further comprising:

sensing a temperature of a controller by using a temperature sensor;

counting a number of one or more set patterns comprising the set pattern in the input image data for one frame;

comparing the temperature of the controller sensed by the temperature sensor with a reference temperature;

generating a mura correction control signal having a first level in response to the counted number of the one or more set patterns being less than a reference pattern number or in response to the temperature of the controller being less than the reference temperature; and generating the mura correction control signal having a second level in response to the counted number of the one or more set patterns being greater than or equal to the reference pattern number and the temperature of the controller being greater than or equal to the reference temperature, wherein the mura correction operation is performed in response to the mura correction control signal having the first level, and the mura correction operation is not performed in accordance with the mura correction control signal having the second level.

20. The method of claim 16, further comprising:

detecting a frame frequency of the input image data by using a driving frequency detection circuit;

counting a number of one or more set patterns comprising the set pattern in the input image data for one frame;

comparing the frame frequency detected by the driving frequency detection circuit with a reference frequency;

generating a mura correction control signal having a first level in response to the counted number of the one or more set patterns being less than a reference pattern number or in response to the frame frequency being less than the reference frequency; and generating the mura correction control signal having a second level in response to the counted number of the one or more set patterns being greater than or equal to the reference pattern number and the frame frequency being greater than or equal to the reference frequency, wherein the mura correction operation is performed in response to the mura correction control signal having the first level, and the mura correction operation is not performed in accordance with the mura correction control signal having the second level.

* * * * *